United States Patent [19]

Kanno et al.

[11] Patent Number: 5,035,953

[45] Date of Patent: Jul. 30, 1991

[54] PROCESS FOR THERMAL TRANSFER RECORDING AND HEAT-SENSITIVE TRANSFER MATERIAL

[75] Inventors: Nobumori Kanno; Kunio Ishii; Neiji Takeda; Hiroyuki Nihashi, all of Tokyo, Japan

[73] Assignee: Toyo Ink Manufacturing Co., Ltd., Tokyo, Japan

[21] Appl. No.: 370,880

[22] Filed: Jun. 23, 1989

[30] Foreign Application Priority Data

Jun. 28, 1988 [JP] Japan ..... 63-160459

[51] Int. Cl.[5] ..... B41M 5/26

[52] U.S. Cl. ..... 428/484; 428/195; 428/488.1; 428/488.4; 428/500; 428/913; 428/914

[58] Field of Search ..... 428/195, 484, 488.1, 428/488.4, 321.3, 913, 914, 500

[56] References Cited

U.S. PATENT DOCUMENTS 4,865,913 9/1989 Takeuchi et al. ..... 428/913

FOREIGN PATENT DOCUMENTS 0194106 9/1986 European Pat. Off. ..... 428/195
55-105579 8/1980 Japan ..... 428/195
60-135294 7/1985 Japan ..... 428/195
62-1574 1/1987 Japan ..... 428/195
62-130880 6/1987 Japan ..... 428/195

OTHER PUBLICATIONS

Nikkei Electronics, pp. 171–173, 1984.5.7.

*Primary Examiner*—Pamela R. Schwartz
*Attorney, Agent, or Firm*—Wenderoth, Lind & Ponack

[57] ABSTRACT

A process for multi-gradation thermal transfer recording which provides a receptor with an image of multi-gradation, the process comprising placing on the receptor a heat-sensitive transfer material comprised of a substrate film, an adhesive layer on one surface of the substrate film, a heat-melting ink layer thereon and a transfer-control layer formed on the heat-melting ink layer, and charging the heat-sensitive transfer material with various levels of energy depending upon image signals from the substrate side to allow the heat-melting ink of the heat-melting ink layer to transfer to the receptor in an amount that corresponds to the various levels of energy, and a multi-gradation heat-sensitive transfer material to be used in the above process.

7 Claims, 1 Drawing Sheet

PROCESS FOR THERMAL TRANSFER RECORDING AND HEAT-SENSITIVE TRANSFER MATERIAL

FIELD OF THE INVENTION

This invention relates to a process for thermal transfer recording in which multi-gradation reproduction can be carried out, and to a heat-sensitive transfer material for multi-gradation reproduction. More specifically, it relates to a process for thermal transfer recording which exhibits excellent ability of multi-gradation reproduction by controlling the transfer amount of a coloring material to a recording sheet depending upon the magnitudes of energy charged from a thermal head, and to a heat-sensitive transfer material usable therefor.

DESCRIPTION OF RELATED ART

In conventional heat-sensitive transfer materials simply comprising a substrate film and a heat-melting ink layer thereon, the ink of the heat-melting ink layer is entirely transferred to a recording sheet (receptor) in one transfer, and it has not been possible to carry out gradation recording depending upon the magnitudes of charged energy. Heat-sensitive transfer materials of various types for multi-gradation reproduction have been proposed in order to improve such a defect of the conventional heat-sensitive transfer materials.

For example, Japanese Laid-Open Patent Publication No. 219087/1983 discloses a technique of laminating ink layers on a substrate in such a manner that one ink layer having a higher melting point is laminated closer to the substrate than another ink layer having a lower melting point, and placing an intermediate layer therebetween. Thus, the transfer amount of these ink layers depends upon the magnitudes of charged energy. However, this technique has a defect that expression in fine gradation is difficult.

Japanese Laid-Open Patent Publication No. 64390/1984 discloses a structure in which a heat-melting ink layer is formed on a substrate film and the heat-melting ink layer contains a blowing agent in a dispersed state. This technique attempts to control the transfer amount of ink on the basis of the blowing degree of the blowing agent depending on charged energy. However, it also has the same defect as that discussed on the above publication, i.e., expression in fine gradation is difficult.

Japanese Laid-Open Patent Publication No. 106997/1984 discloses a technique in which a substrate is provided with a sublimation ability-possessing layer containing a coloring matter of which the sublimation transfer can be controlled by heating, and a heat-melting layer containing a heat-melting compound. The technique of this publication using a sublimation ability-possessing dye exhibits a sufficient print resolution and gradation characteristic. Since, however, this technique is limited to the use of a dye, it has a disadvantage concerning weatherproofness.

Further, when the techniques disclosed in Japanese Laid-Open Patent Publications Nos. 64390/1984 and 106997/1984 are used in a printer having a high platen pressure and a slow printing speed, separation sometimes occurs in the interface between an ink layer and the substrate film.

Japanese Laid-Open Patent Publication No. 137891/1988 discloses a heat-sensitive transfer material for multi-use purpose. However, it suggests nothing concerning the possiblity and suitability of its use for multi-gradation recording.

SUMMARY OF THE INVENTION

It is an object of this invention to provide a process for thermal transfer recording in which the transfer amount of a heat-melting ink into a receptor can be controlled on the basis of the magnitudes of energy charged from a thermal head, and a heat-sensitive transfer material for multi-gradation expression.

It is another object of this invention to provide a process for thermal transfer recording which exhibits excellent ability of multi-gradation reproduction, and a heat-sensitive transfer material for multi-gradation expression.

According to this invention there is provided a process for thermal transfer recording which provides a receptor with an image of multi-gradation, the process comprising placing on the receptor a heat-sensitive transfer material comprised of a substrate film, an adhesive layer formed on one surface of the substrate film, a heat-melting ink layer thereon and a transfer control layer formed on the heat-melting ink layer, and charging the heat-sensitive transfer material with various levels of energy depending upon image signals from the substrate side to allow the heat-melting ink to the receptor in such an amount that corresponds to the various levels of energy.

According to this invention there is further provided a heat-sensitive transfer material for multi-gradation expression which comprises a substrate film, an adhesive layer formed on one surface of the substrate film, a heat-melting ink layer thereon and a transfer control layer formed on the heat-melting ink layer, in which the heat-melting ink of the heat-melting ink layer is allowed to transfer to a receptor depending upon charged energy.

BRIEF DESCRIPTION OF THE INVENTION

DETAILED DESCRIPTION OF THE INVENTION

It has been found that the heat-sensitive transfer material of this invention unexpectedly exhibits excellent ability of multi-gradation reproduction.

In this invention, the adhesive layer formed to firmly bond the substrate film and the heat-melting ink layer can prevent the separation of the substrate film and the heat-melting ink in their interface, i.e. it prevents the transfer of the heat-melting ink and the transfer control layer at one time, and due to the transfer control layer, the amount of the ink can be suitably controlled. For this reason, the transfer amount of a coloring material can be controlled depending upon image signals, etc., i.e. the magnitudes of charged energy from a thermal head.

In this invention, the receptor referred to hereinabove stands for ordinary heat-sensitive recording media such as paper, and when the heat-melting ink layer uses a leuco dye but does not contain any developer, a developer-containing sheet is used as a receptor.

The present invention will be explained according to the drawings.

Figure 1:
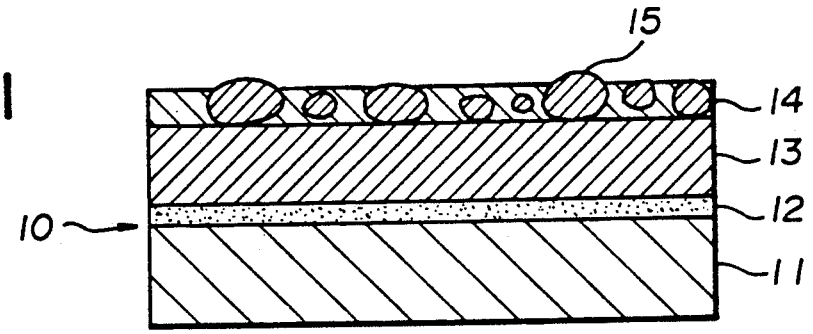
FIG. 1 is a cross-sectional view of a heat-sensitive transfer material of this invention, which has a transfer control layer filled with a heat-melting resin or a heat-melting ink.
Figure 2:
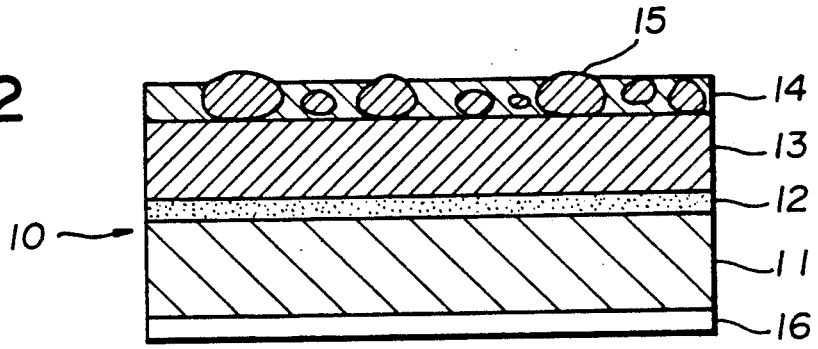
FIG. 2 is a cross sectional view of a heat-sensitive transfer material of this invention, which has a heat-resistant layer on the other surface of the substrate.
Figure 3:
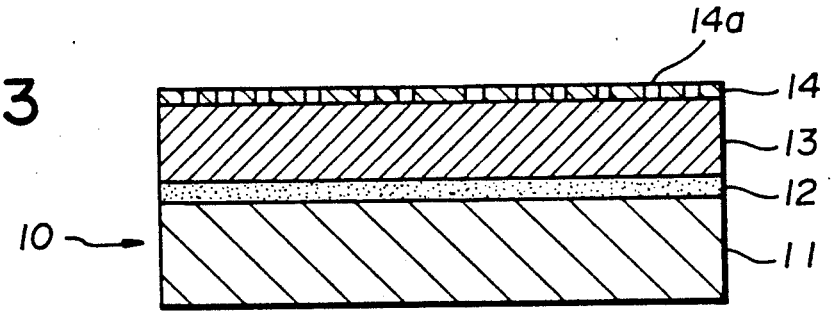
FIG. 3 is a cross-sectional view of a heat-sensitive transfer material of this invention, which has a transfer control layer having through holes.

FIGS. 1 to 3 are cross-sectional views of an embodiment of a heat-sensitive transfer material 10 of the present invention, which is formed by providing one surface of a substrate film 11 with an adhesive layer 12 and a heat-melting ink layer 13 and providing a transfer control layer 14 onto said heat-melting ink layer. In some cases, a heat-resistant layer 16, which is called a backcoat, may be formed on the other surface of the substrate film (i.e. on one surface on which no heat-melting layer is formed). The transfer control layer 14 has a surface which is provided with many micropores which reach up to the ink layer 13. In a more preferable embodiment, a heat-melting resin (low-melting point resin) or heat-melting ink 15 is filled or held in said pores. The drawings show a state where the heat-melting resin or heat-melting ink 15 partially projects above the surface of the transfer control layer 14. However, in some cases, it is almost embedded.

In this invention, the transfer control layer stands for a layer which permits a molten ink of the heat-melting ink layer to pass through said pores or pores which are filled with the heat-melting resin or heat-melting ink, and the transfer amount can be also controlled by suitably selecting the diameters of said pores and the number of said pores.

Usable as the substrate film 11 are those which are usually used as a heat-sensitive transfer substrate film, i.e. plastic films such as polyester films or condenser papers.

Preferably usable as the adhesive layer 12 are high-molecular-weight compounds which have an adhesion ability to both the substrate film and the heat-melting ink at a temperature in the range of from 0° C. to 80° C., preferably from 10° C. to 60° C. Examples of such high-molecular-weight compounds include an ethylene-ethyl acrylate copolymer, ethylenevinylacetate copolymer, polyvinyl butyral, polyester resin, polyamide resin, styrene-butadiene copolymer, acryronitrile-butadiene coplymer, raw rubber, acrylic resin, polyurethane resin, etc., and they can be used alone or as a mixture of two or more of these. In addition to the above-mentioned thermoplastic resins, crosslinking resins such as thermally crosslinking high polymers or radically crosslinking resins may be used, if they have adhesion ability within the above temperature range.

The adhesive layer 12 has a thickness, preferably, of 0.05 to 5 μm, and may be sufficiently formed on the substrate layer 11 from a solvent solution of one or more of the above high-molecular-weight compounds by using a coating device such as a device for a gravure method.

The heat-melting ink layer 13 is that which is obtained by melting and kneading a pigment or dye such as carbon black, leuco dye, paraffin wax or natural wax, thermoplastic resin such as ethylene-vinyl acetate copolymer, etc., dispersant, or the like. The heat-melting ink layer 13 may be usually applied by hot-melt coating, and in some cases, it may also be formed by gravure coating of a dispersion obtained by dispersing the above heat-melting ink composition in a solvent. The thickness of the heat-melting ink layer 13 is preferably 1 μm to 20 μm.

The transfer control layer 14 is that which is obtained by converting an essentially heat-resistant high-molecular-weight compound to a porous one. As examples of such a high-molecular-weight compound, it is possible to cite thermoplastic resins or thermosetting resins such as polyester resin, acrylic resin, polyurethane resin, butyral resin, polyamide resin, cellulose resin and polycarbonate resin. In some cases, instead of using the above resins, the above high-molecular-weight compound may be formed by applying a radiation-curing monomer and then irradiating ultraviolet ray, electron beam and the like.

The high-molecular-weight compound of the transfer control layer can be rendered porous by any known methods, for example:

(1) a method of forming a coating from a solution of a high-molecular-weight compound containing a blowing agent and then permitting the blowing agent to blow by heat treatment.

(2) a method of forming a coating from a solution of a high-molecular-weight compound in which a water-soluble substance is finely dispersed and then removing the water-soluble substance by immersion in water.

(3) a method of adding a solvent having a relatively high boiling point to a solution of a high-molecular-weight compound, forming a coating and then evaporating the high-boiling-point solvent by heat treatment.

(4) a method of forming a coating from a solution of a high-molecular-weight compound in which a low-melting-point substance such as wax or a low-molecular-weight compound, or heat-melting ink is finely dispersed, and then drying.

Of the above-cited methods of forming pores, the method (4) is practically preferable from the viewpoint that no post treatment is necessary. More specifically, the fine dispersion of a heat-melting resin or heat melting ink in the high-molecular weight compound which is a heat-resistant resin is prepared by finely dispersing the heat-melting resin or heat-melting ink by adding a solution of 20 to 400 parts by weight, preferably 50 to 200 parts by weight, of the high-molecular-weight compound to 100 parts by weight of the heat-melting resin or heat-melting ink. The organic solvent to be used for the preparation of the above fine dispersion needs to be selected from those which dissolve the heat-resistant resin but do not dissolve the heat-melting resin or heat-melting ink. The heat-melting resin or heat-melting ink is converted to fine particles by using a dispersing apparatus such as a ball mill, atriter, sand mill, or the like. For example, the solution of the heat-resistant resin may be mixed with the heat-melting resin or heat-melting ink and stirred to convert the heat-melting resin or heat-melting ink to fine particles by using glass beads or steel beads. When the heat-melting resin or heat-melting ink is converted to fine particles, additives such as a dispersant, fine powder silica gel, etc., may be added in combination.

Examples of the above solvent which does not dissolve or hardly dissolves the heat-melting resin or heat-melting ink include alcohols such as methyl alcohol, ethyl alcohol, isopropyl alcohol, n-butyl alcohol, etc., ketones such as acetone, methyl ethyl ketone, methyl-n-propyl ketone, etc., esters such as ethyl acetate, isopropyl acetate, n-butyl acetate, etc., water, a mixture of these, and the like.

As the resin component of the heat-melting resin or heat-melting ink usable in this invention, it is possible to cite natural waxes such as candelilla wax, carnauba wax, rice wax, haze wax, montan wax, etc., petroleum waxes such as paraffin wax, microcrystalline wax, etc., synthetic waxes from coal, polyethylene wax and synthetic waxes from fats and oils such as fatty acid amide, aliphatic ketone, aliphatic amine, fatty acid ester etc., and others.

When the heat-melting resin or heat-melting ink is converted to fine particles and dispersed in the presence of the solution of the heat-resistant resin, if the viscosity of the solution of the heat-resistant resin is too high, it is difficult to convert the heat-melting resin or heat-melting ink into fine particles.

The viscosity of the solution of the heat-resistant resin is, preferably, not more than 2,000 centipoise.

The size of the fine particles of the heat-melting resin or heat-melting ink influences on the density and resolution of characters and letters in thermal transfer.

The diameter of the fine particles of the heat-melting resin or heat-melting ink is in the range of, preferably, from 0.01 μm to 50 μm, and more preferably, of from 0.1 μm to 20 μm. If said diameter is in the above range, multi-gradation recording is excellent and the resolution of transferred letters is sufficient. If said diameter is larger than the above range, resolution of letters is insufficient.

Further, the transfer control layer may be formed by using a polymer (particles) of vinyl-type monomer which is a heat-melting resin and a heat-resistant resin which is incompatible with said polymer (particles).

The above polymer, which is usually particulate, is a (co)polymer containing at least one monomer selected from the following vinyl-type monomer group A as essential component and monomer(s) selected from the following vinyl-type monomer group B as optional component.

Vinyl-type monomer group A:

The vinyl-type monomer, which has a long chain alkyl group having not less than 17 carbon atoms, is, in general, acrylic ester or methacrylic ester of higher alcohol having not less than 17 carbon atoms, represented by the following general formula $$CH_2{=}\overset{\overset{R_1}{|}}{C}{-}COOR_2$$

wherein $R_1$ is H, $CH_3$, $C_2H_5$, $C_3H_7$, or the like and $R_2$ is a long chain alkyl group having not less than 17 carbon atoms, such as ester of an alcohol such as heptadecyl alcohol, stearyl alcohol, nonadecyl alcohol, eicosyl alcohol, heneicosyl alcohol, docosyl alcohol, tricosyl alcohol, tetracosyl alcohol or the like with acrylic acid or methacrylic acid.

Vinyl-type monomer group B:

Vinyl-type monomers such as acrylic esters of acrylic acid, methyl acrylate, ethyl acrylate, hexyl acrylate, etc., methacrylic esters of methacrylic acid, ethyl methacrylate, hexyl methacrylate, etc., acrylonitrile, acrylic acid amide, methacrylic acid amide, styrene, vinyl acetate, vinyl esters, styrene, and the like.

The particulate polymer is obtained by polymerizing the above vinyl-type monomer(s) according to an ordinary method of solution polymerization, suspension polymerization, emulsion polymerization or the like, and preferably, the polymer has a molecular weight of about 1,000 to about 100,000. The polymer (particles) has a melting point in the range, preferably, of from 30° to 150° C., and more preferably of from 40° to 120° C.

The particulate polymer may be an ink which is colored with a coloring agent having the same color as that of the heat-melting ink layer.

The particulate polymer is dispersed in a solvent, which does not dissolve said particulate polymer, or in water, to form a fine dispersion. For this purpose, examples of the solvent usable to polymerize the vinyl-type monomer(s) are water or solvents which do not dissolve the particulate polymer at room temperature such as alcohols and hydrocarbons, and these solvents are used alone or in combination.

The resultant fine dispersion of the particulate polymer is mixed with a solution of the heat-resistant resin, and the mixture is applied on the heat-melting ink layer formed on the substrate film and then dried to give a transfer control layer of this invention.

The polymerization of the vinyl-type monomer may be carried out in a solution of part or whole of the heat-resistant resin in the above-mentioned solvent.

Examples of the heat-resistant resin are those which have high glass transition points and are selected from acrylic resins, polyamide resins, polyester resins, epoxy resins, polyvinyl butyral, cellulose-type resins, polyvinyl alcohol, etc., and these are used alone or in combination with each other or in combination with a curing agent.

The heat-resistant resin is at least required to be soluble in the solvent used to form the dispersion of the particulate polymer, and further it is essential that the vinyl-type polymer particles and the heat-resistant resin are not mutually dissolved. That is, in order to achieve multi-gradation expression by means of the transfer control layer formed of the particulate polymer and the heat-resistant resin, it is necessary that the particulate polymer alone should melt to flow out and that the heat-melting ink should seep out little by little through the same places by means of head energy when printing. For this reason, the particulate polymer and the heat-resistant resin are required not to dissolve each other.

The size of the vinyl-type particulate polymer can be controlled to some extent by means of the amount of an initiator, composition of the solvent and cooling speed.

FIGS. 1 and 2 show a transfer control layer 14 formed by the above method (4), in which the small and large particles 15 of the heat-melting resin or heat-melting ink are held in the layer of the heat resistant resin of the high-molecular-weight compound.

FIG. 3 shows a transfer-control layer 14 formed by the above methods (1), (2) and (3), in which many through-pores **14*a* are formed in the layer of a high-molecular-weight compound which is a heat-resistant resin. The transfer control layer 14 so formed may be further subjected to heat treatment by a heating roll, etc., to fill the through-pores 14*a* with an ink of a heat-melting ink layer 13**.

Further, a heat-sensitive transfer material having the transfer control layer (containing fine particles of heat-melting resin) obtained by the above method (4) may be heat treated at a temperature not lower than the softening point of the heat-melting resin. When the heat-melting resin is held in the pores, heat treatment is preferable, since the resin is mixed with the ink layer positioned beneath by the heat treatment, and excellent printing can be carried out with even a low charge of energy.

The transfer control layer 14 has a thickness, preferably, of from 0.1 μm to 5 μm. In addition, the transfer control layer 14 is substantially non-transferable.

In the heat-sensitive material of this invention, the substrate film and the heat-melting ink layer have an adhesive layer therebetween and are firmly bonded. Hence, the separation of the substrate film and the heat-melting ink in their interface can be prevented. This is also one of the factors for achievement of multi-gradation recording.

Further, in this invention, a heat-sensitive transfer material of full color multi-gradation recording type can be obtained by arranging (coating) the pigments of the ink layer such that they are positioned side by side in the order of, e.g. yellow, magenta, cyan, black, etc.

A heat-sensitive transfer material of full color multi-gradation recording type can be also obtained by arranging (coating) leuco dyes such that developed colors are in the order of, e.g. yellow, magenta, cyan, black, etc. A developer may be contained in the ink layer or in the receptor.

Figure 4:
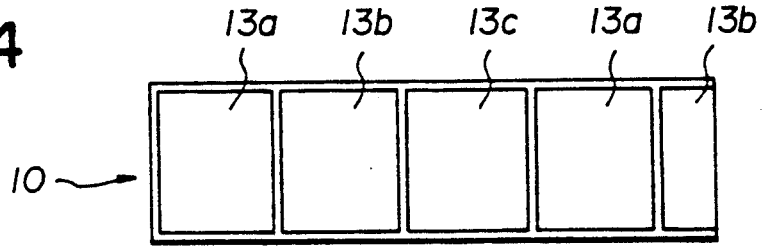
FIG. 4 illustrates a heat-sensitive transfer material of this invention, which has an ink layer having sections of different coloring pigments.

FIG. 4 shows an embodiment of a heat-sensitive layer in which the pigments or leuco dyes are repetitively arranged in the order of yellow 13*a*, magenta 13*b* and cyan 13*c*. Black also may be added.

This invention will be explained hereinbelow according to Examples and Comparative Examples, in which "part" stands for "part by weight".

EXAMPLE 1

Ten parts of an ethylene-vinyl acetate coplymer (Ultrathene UE-760, trade name, made by Toyo Soda K.K.) was dissolved in 90 parts of toluene to obtain an adhesive (A1).

Separately, 20 parts of carbon black, 50 parts of paraffin wax, 20 parts of carnauba wax and 10 parts of an ethylene-vinyl acetate copolymer were fully kneaded at 90° C. to prepare a heat-melting ink (B1).

Further, 5 parts of polyester resin (Vylon 200, trade name, made by Toyo Boseki K.K.), was dissolved in 25 parts of methyl ethyl ketone. Then, 30 parts of this polyester resin solution and 5 parts of the heat-melting ink (B1) were dispersed in a ball mill with 30 parts of glass beads to obtain an ink dispersion coating liquid (C1).

Then, the adhesive (A1) was coated on a polyester film having a thickness of 6 μm by using a wire bar such that its thickness was 0.5 μm, and then the solvent was dried off. The heat-melting ink (B1) was melted at 90° C. and applied on this adhesive layer by a wire bar such that its thickness was 4 μm.

Thereafter, the coated material was cooled to room temperature. The ink dispersion coating liquid (C1) was coated on the heat-melting ink (B1) such that its thickness was 1 μm, and the solvent was dried off to give a heat-senstive transfer film sample 1.

EXAMPLE 2

Example 1 was repeated except that a styrene-butadiene copolymer [adhesive (A2)], (Califlex TR-1101, trade name, made by Shell Chemical K.K.), was used in place of ethylene-vinyl acetate copolymer used in Example 1 for the adhesive (A1), to give a heat-sensitive transfer film sample 2.

EXAMPLE 3

Example 1 was repeated as follows.

A heat-melting ink was obtained by melting and kneading 20 parts of carbon black, 45 parts of paraffin wax, 30 parts of carnauba wax and 5 parts of an ethylene-vinyl acetate copolymer was used, as a substitute for the heat-melting ink (B1) of Example 1, and the heat-melting ink so obtained was dispersed in a polyester resin solution in the same way as in Example 1 to obtain an ink dispersion coating liquid (C2). And the procedure thereafter was repeated in the same way as in Example 1 to give a heat-sensitive transfer film sample 3.

EXAMPLE 4

Five parts of polyester resin (Vylon 200, trade name, made by Toyobo K.K.) was dissolved in 25 parts of methyl ethyl ketone. 30 parts of this polyester resin solution and 5 parts of carnauba wax were dispersed in a ball mill with 30 parts of glass beads to obtain a heat-melting resin dispersion coating liquid (C3).

The adhesive (A1) of Example 1 was applied onto a polyester film having a thickness of 6 μm such that its thickness was 0.5 μm, and then the heat-melting ink (B1) was melted at a temperature of 90° C. and applied thereon with a wire bar such that its thickness was 4 μm. The coated material was cooled to room temperature. Then the heat-melting resin dispersion coating liquid (C3) was applied on the heat-melting ink (B1) with a wire bar such that its thickness was 0.5 μm, and the solvent was dried off to give a heat-sensitive transfer film sample 4.

EXAMPLE 5

Example 4 was repeated by using a heat-melting resin dispersion coating liquid (C4) obtained by using acrylic resin (BR-80, trade name, made by Mitsubishi Rayon K.K.) in place of Vylon 200 of Example 4, to give a heat-sensitive transfer film sample 5

EXAMPLE 6

Five parts of nitro cellulose (Celnova BTH ½ second, trade name, made by Asahi Kasei K.K.) was dissolved in a mixture solvent containing 15 parts of methy ethyl ketone and 15 parts of isopropyl alcohol. 35 parts of this solution and 6 parts of rice wax were dispersed in a ball mill with 30 parts of glass beads to obtain a heat-melting resin dispersion coating liquid (C5).

An adhesive layer was formed on a polyester film having a thickness of 6 μm in the same way as in Example 2 by using the adhesive (A2) of Example 2. Further, the heat-melting ink (B1) of Example 1 was melted at 90° C. and applied with a wire bar such that its thickness was 4 μm, and, after the coated material was cooled, the heat-melting resin dispersion coating liquid (C5) was applied with a wire bar such that its thickness was 1 μm. The solvent was dried off to give a heat-sensitive transfer film sample 6.

COMPARATIVE EXAMPLE 1

The heat-melting ink (B1) prepared in Example 1 was coated on a polyester film having a thickness of 6 μm at 90° C. with a wire bar such that its thickness was 4 μm.

The resultant material is referred to as a heat-sensitive transfer film sample 7.

COMPARATIVE EXAMPLE 2

The heat-melting ink (B1) prepared in Example 1 was coated on a polyester film at 90° C. with a wire bare such that its thickness was 4 μm. Then, the heat-melting resin dispersion coating liquid (C3) prepared in Example 4 was coated thereon such that its thickness was 0.5 μm.

The resultant material is referred to as a heat-sensitive transfer material sample 8.

EXAMPLE 7

Twenty parts of carbon black, 50 parts of paraffin wax, 20 parts of candelilla wax and 10 parts of an ethylene-vinyl acetate copolymer were fully kneaded at 90° C. to prepare a heat-melting ink (B2).

Five parts of polyester resin (Vylon 200, trade name, made by Toyobo K.K.) was dissolved in 25 parts of methyl ethyl ketone. This solution and 5 parts of the above heat-melting ink (B2) were kneaded in a ball mill for 1 hour to obtain an ink dispersion coating liquid.

Polyisocyanate (0.5 parts, Colonate L, trade name, made by Nippon Polyurethane K.K.) as a curing agent and 0.01 part of stannous octenoate as a catalyst were added to 20 parts of the above ink dispersion coating liquid, and fully mixed to obtain an ink dispersion coating liquid (C6).

The adhesive (A1) of Example 1 was applied on a polyester film having a thickness of 6 μm such that its thickness was 1 μm, and the solvent was dried off. The heat-melting ink (B2) was melted at 90° C. and applied on the adhesive layer with a wire bar such that its thickness was 4 μm. The coated material was then cooled to room temperature, and the ink dispersion coating liquid (C6) was applied on the ink (B2) with a wire bar such that its thickness was 1 μm, and the coated material was dried at 50° C. for 1 day.

The resultant film is referred to as a heat-sensitive transfer film sample 9.

EXAMPLE 8

Four parts of acrylic resin (Aronix M-7100, trade name, made by Toa Gosei Chemical K.K.), 1 part of acrylic monomer (A-TMPT, trade name, made by Shin-Nakamura Chemical K.K.), 0.2 part of a sensitizer (Dalocure 1173, trade name, made by Merck Japan K.K.), 25 parts of methyl ethyl ketone and 6 parts of the heat-melting ink (B1) were mixed and shaken in a ball mill with 30 parts of glass beads for 1 hour. This ink is referred to as an ink dispersion coating liquid (C7).

The adhesive layer of Example 2 was applied on a polyester film having a thickness of 6 μm such that its thickness was 0.5μ, and the solvent was dried off. The heat-melting ink (B1) was melted at 90° C. and applied on the adhesive layer with a wire bar such that its thickness was 4 μm. The coated material was then cooled to room temperature, and the ink dispersion coating liquid (C7) was applied on the heat-melting ink (B1) with a wire bar such that its thickness was 1 μm. Then the solvent was dried off at room temperature.

That surface of the resultant sample which was coated with the ink dispersion coating liquid (C7) was subjected to irradiation with an 80 W/cm high pressure mercury lamp located at 15 cm apart at a conveyer speed of 10 m/minute to give a heat-sensitive transfer film sample 10.

EXAMPLE 9

Twenty parts by weight of methyl isobutyl ketone, 44.5 parts of isopropyl alcohol and 10 parts of stearyl acrylate were charged into a flask, and while the mixture was stirred in nitrogen atmosphere, the temperature was elevated to 85° C.

Twenty-five parts of methyl isobutyl ketone and 0.5 part of benzoyl peroxide were charged into a dropping tube, and added dropwise to the flask over 1 hour. While the temperature was maintained at 85° C., the reaction was continued for 1 hour after the addition was finished.

Then, the reaction liquid was cooled with water while it was rapidly stirred, to give a dispersion. Separately, 3 parts of nitrocellulose (Celnova BTH ½ second, trade name, made by Asahi Kasei K.K.) was dissolved in 40 parts of methyl isobutyl ketone, and 27 parts of the dispersion and 30 parts of isopropyl alcohol were mixed therewith to give a heat-melting resin dispersion coating liquid (C8).

An adhesive layer was formed on a polyester film having a thickness of 6 μm in the same way as in Example 1 by using the adhesive (A1), and the heat-melting ink (B1) was melted at 90° C. and applied on this adhesive layer with a wire bar such that its thickness was 5 μm. The coated material was then cooled to room temperature, and the heat-melting resin dispersion coating liquid (C8) was applied on the heat-melting ink (B1) with a wire bar such that its thickness was 1 μm and the solvent was fully dried off.

The resultant film is referred to as a heat-sensitive transfer film sample 11.

EXAMPLE 10

Fifteen parts of nitrocellulose (Celnova BTH ½ second, trade name, made by Asahi Kasei K.K.), 25 parts of methyl isobutyl ketone and 10 parts of isopropyl alcohol were charged into a flask, and while the mixture was stirred, the temperature was elevated to 85° C. 15 parts of stearyl acrylate, 0.75 part of 2,2'-azobisisobutyronitrile, 17.25 parts of methyl isobutyl ketone and 17 parts of isopropyl alcohol were charged to a dropping tube and fully mixed. Then, the mixture was added dropwise to the flask over 1 hour. The mixture was further stirred for 1 hour at 85° C., and then cooled with ice water with stirring it rapidly.

Forty parts of isopropyl alcohol and 44 parts of methyl isobutyl ketone were added to 16 parts of the above dispersion and mixed fully therewith to give a heat-melting resin dispersion coating liquid (C9).

The adhesive (A2), the heat-melting ink (B2) and the heat-melting resin dispersion coating liquid (C9) were applied successively on a polyester film having a thickness of 6 μm to give a heat-sensitive transfer film sample 12.

COMPARATIVE EXAMPLE 3

Example 9 was repeated except that no adhesive layer was formed, to give a thermal transfer material. The obtained sample is referred to as a heat-sensitive transfer film sample 13.

EXAMPLE 11

A gravure ink each of yellow, magenta and cyan was obtained by fully kneading and dispersing the following ink composition of each color.

Yellow ink

Ten parts of Linol Yellow GR (trade name, made by Toyo Ink Manufacturing Co., Ltd., C.I. pigment yellow 12), 55 parts of paraffin wax, 20 parts of carnauba wax and 15 parts of an ethylene-vinyl acetate coplymer (Ultrathene UE-760, trade name, made by Toyo Soda K.K.) were fully kneaded at 90° C. to give a heat-melting yellow ink.

Then, 20 parts of the above heat-melting yellow ink and 80 parts of isopropyl alcohol were dispersed in a ball mill with 100 parts of glass beads to give an yellow gravure ink (B3).

Magenta ink

Ten parts of Linol Red B (trade name, made by Toyo Ink Manufacturing Co., Ltd., C.I. Pigment Red 38) was substituted for Linol Yellow GR used in the preparation procedure for the above "heat-melting yellow ink", and the procedure was repeated to give a heat-melting magenta ink.

Then, 20 parts of the above heat-melting magenta ink and 80 parts of isopropyl alcohol were dispersed in a ball mill with 100 parts of glass beads to give a magent a gravure ink (B4).

Cyan ink

Ten parts of Linol Blue KL (trade name, made by Toyo Ink Manufacturing Co., Ltd., C.I. Pigment Blue 15-3) was substituted for Linol Yellow GR used in the preparation procedure for the above "heat-melting yellow ink", and the procedure was repeated to give a heat-melting cyan ink.

Then, 20 parts of the above heat-melting cyan ink and 80 parts of isopropyl alcohol were dispersed in a ball mill with 100 parts of glass beads to give a cyan gravure ink (B5).

The adhesive (A1), yellow gravure ink (B3), magenta gravure ink (B4) and cyan gravure ink (B5) were coated on a polyester film having a thickness of 6 μm by using a four-color gravure printing machine such that their thicknesses were respectively 0.5 μm, 4 μm, 4 μm and 4 μm and that the certain sizes of the yellow gravure ink (B3), magenta gravure ink (B4) and cyan gravure ink (B5) were positioned side by side. Then, the heat-melting resin dispersion coating liquid (C3) was coated thereon by using the above gravure printing machine such that its thickness was 0.5 μm, to give a heat-sensitive tranfer film sample 14.

EXAMPLE 12

Example 11 was repeated except that gravure inks using dyes for yellow, magenta and cyan in place of the pigments for such colors were used to give a heat-sensitive transfer film sample 15.

The preparation of each of the above gravure inks was as follows:

The yellow gravure ink (B6) was obtained by dispersing the following components in a ball mill with 100 parts of glass beads.

Oil color yellow #101 (trade name, made by Orient Chemical Co., Ltd.): 10 parts

Carnauba wax: 10 parts

Ethylene-vinyl acetate coplymer (Ultrathene UE-760, trade name, made by Toyo Soda K.K.): 5 parts Toluene: 75 parts For the magenta gravure ink (B7), Oil color pink #312 (trade name, made by Orient Chemical Co., Ltd.) was used in place of the oil color yellow #101, and the same procedure as above was repeated.

For the cyan gravure ink (B8), Oil color blue BOS (trade name, made by Orient Chemical Co., Ltd.) was used in place of the oil color yellow #101, and the same procedure as above was repeated.

EXAMPLE 13

Example 11 was repeated except that gravure inks using heat-melting coloring matters for yellow, magenta and cyan in place of the pigments for such colors were used, to give a heat-sensitive transfer film sample 16.

The preparation of each of the coloring matters was as follows.

The heat-melting magenta coloring matter (D1) was prepared by dissolving 3 parts of sodium oleate in water having a temperature of between 60° C. and 70° C., adding thereto 5 parts of Rhodamine 6 GCP (trade name, made by Hodogaya Chemical Co., Ltd., C.I. Basic Red 1), continuously stirring the mixture with maintaining the above temperature for 3 hours, then filtering a reaction product, washing it and drying it at 60° C. for 48 hours.

The heat-melting yellow coloring matter (D2) was prepared in the same way as above except that C.I. Basic Yellow 11 was used in place of C.I. Basic Red 1.

The heat-melting cyan coloring matter (D3) was also prepared in the same way as above except that C.I. Basic Blue 24 was used in place of C.I. Basic Red 1.

The preparation of each of the gravure inks was as follows.

The yellow gravure ink was obtained by dispersing the following components in a ball mill with 100 parts of glass beads.

The heat-melting yellow coloring matter (D2): 20 parts

Ethylene-vinyl acetate coplymer (Ultrathene UE-760, trade name, made by Toyo Soda K.K.): 5 parts Toluene: 75 parts For the magenta gravure ink, the heat-melting magenta coloring matter was used in place of the heat-melting yellow coloring matter, and the same procedure as above was repeated.

For the cyan gravure ink, the heat-melting cyan coloring matter was used in place of the heat-melting yellow coloring matter, and the same procedure as above was also repeated.

EXAMPLE 14

Example 11 was repeated except that gravure inks using leuco dyes to color yellow, magenta and cyan in place of the pigments for such colors were used, to give a heat-sensitive transfer film sample 17.

The preparation of each of the gravure inks was as follows.

A developer dispersion (D4) was prepared by dispersing 40 parts of n-butyl p-xoxybenzoate, 4 parts of a polyvinyl alcohol resin (PVA224, trade name, made by Kuraray Co., Ltd) and 56 parts of water in a ball mill with 100 parts of glass beads.

A leuco dye dispersion (D5) was prepared by dispersing 10 parts of 3-cyclohexylamino-6-chlorofluorine, 50 parts of a 20% paraffin wax emulsion, 4 parts of PVA224 and 36 parts of water in a ball mill with 100 parts of glass beads.

The the developer dispersion (D4) and the leuco dye dispersion (D5) were mixed in a mixing ratio of 1:1 and stirred to give an yellow gravure to develop a yellow color at a thermal transfer time.

For magenta gravure ink (D6), 3-diethylamino-7,8-benzfluorine was used in place of 3-cyclohyxylamino-6-chlorofluorine, and the same procedure as above was repeated.

For cyan gravure ink (D7), 3,3-bis(p-dimethylamino-phenyl)phthalide was used in place of 3-cyclohyxylamino-6-chlorofluorine, and the same procedure as above was also repeated.

EXAMPLE 15

Example 11 was repeated except that gravure inks using leuco dyes to color yellow, magenta and cyan in place of the pigments for such colors were used, to give a heat-sensitive transfer film sample 18.

The preparation of each of the gravure inks was as follows.

The yellow gravure ink (D8) was prepared by dispersing the following components in a ball mill with 100 parts of glass beads.

3-Cyclohexylamino-6-chlorofluorine: 10 parts

Rice wax: 5 parts

Carnauba wax: 5 parts

Ethylene-vinyl acetate coplymer (Ultrathene UE-760, trade name, made by Toyo Soda K.K.): 3 parts Toluene: 80 parts For the magenta gravure ink (D9), 3-diethylamino-7,8-benzfluorine was used in place of 3-cyclohexylamino-6-chlorofluorine, and the same procedure as above was repeated.

For the cyan gravure ink (D10), 3,3-bis(p-dimethylaminophenyl)phthalide was used in place of 3-cyclohexylamino-6-chlorofluorine, and the same procedure as above was also repeated.

EXAMPLE 16

Example 15 was repeated except that the heat-melting resin dispersion coating liquid (C3) was replaced by a heat-melting resin dispersion coating liquid (C10) obtained by dissolving 5 parts of a polyvinyl alcohol resin (R-1130, trade name, made by Kuraray Co., Ltd.) in 25 parts of water and dispersing 30 parts of the resultant polyvinyl alcohol resin solution and 2,2-bis(4'hydroxyphenyl)propane in a ball mill with 30 parts of glass beads, and as a result a heat-sensitive transfer film sample (19) was obtained.

The heat-sensitive transfer films obtained in Examples 1 to 14 and Comparative Examples 1 to 3 were tested to see printing on sheets of ordinary paper with a thermal printer under the conditions that the resolving power was 8 dots/mm, the charged voltage was 0.2 W/dot and the pulse width was changed.

Separately, a developer coating liquid was prepared by dispersing 20 parts of 2,2-bis(4'hydroxyphenyl)propane, 10 parts of fine powder silica, 5 parts of polyvinyl alcohol (R-1130, trade name, made by Kuraray Co., Ltd.) and 100 parts of water in a ball mill with 50 parts of glass beads. And the heat-sensitive transfer films obtained in Examples 15 and 16 were tested to see printing on sheets prepared by coating the developer coating liquid on a high quality paper having a basis weight of 30 g/m$^2$ with a wire bar such that its dried coating weight was 7 g/m$^2$.

The results of measurement of optical reflection densities after the above printing are shown in Table 1 by using charged energy and reflection density.

The optical reflection densities were measured by using a Macbeth RD918 (made by A division of Kollmorgen Corporation).

TABLE 1

| Heat-sensitive transfer film sample No. | Optical reflection density: Charged energy (mJ/dot) 0.6 | 0.9 | 1.2 | 1.5 |
|---|---|---|---|---|
| 1 | 0.4 | 0.8 | 1.2 | 1.4 |
| 2 | 0.4 | 0.7 | 1.1 | 1.4 |
| 3 | 0.3 | 0.7 | 1.1 | 1.4 |

TABLE 1-continued

| Heat-sensitive transfer film sample No. | Optical reflection density: Charged energy (mJ/dot) 0.6 | 0.9 | 1.2 | 1.5 |
|---|---|---|---|---|
| 4 | 0.3 | 0.7 | 1.1 | 1.3 |
| 5 | 0.4 | 0.8 | 1.1 | 1.4 |
| 6 | 0.3 | 0.7 | 1.1 | 1.3 |
| 7 (CEx. 1) | 1.2 | 1.2 | 1.3 | 1.4 |
| 8 (CEx. 2) | peeld | 0.8 | 1.2 | 1.4 |
| 9 | 0.4 | 0.7 | 1.1 | 1.5 |
| 10 | 0.3 | 0.8 | 1.2 | 1.4 |
| 11 | 0.3 | 0.6 | 1.0 | 1.3 |
| 12 | 0.3 | 0.6 | 1.0 | 1.3 |
| 13 (CEx. 3) | peeld | 0.8 | 1.1 | 1.4 |
| 14 Yellow | 0.2 | 0.3 | 0.7 | 0.9 |
| Magenta | 0.2 | 0.5 | 1.0 | 1.2 |
| Cyan | 0.2 | 0.4 | 0.9 | 1.2 |
| 15 Yellow | 0.2 | 0.3 | 0.6 | 0.9 |
| Magenta | 0.2 | 0.4 | 0.7 | 1.1 |
| Cyan | 0.2 | 0.5 | 0.8 | 1.2 |
| 16 Yellow | 0.2 | 0.4 | 0.7 | 1.0 |
| Magenta | 0.2 | 0.5 | 0.8 | 1.2 |
| Cyan | 0.2 | 0.6 | 0.8 | 1.2 |
| 17 Yellow | 0.1 | 0.2 | 0.6 | 0.9 |
| Magenta | 0.1 | 0.2 | 0.6 | 1.1 |
| Cyan | 0.1 | 0.3 | 0.7 | 1.2 |
| 18 Yellow | 0.1 | 0.2 | 0.5 | 0.8 |
| Magenta | 0.1 | 0.2 | 0.6 | 1.0 |
| Cyan | 0.1 | 0.3 | 0.7 | 1.0 |
| 19 Yellow | 0.1 | 0.2 | 0.4 | 0.7 |
| Magenta | 0.1 | 0.2 | 0.5 | 0.9 |
| Cyan | 0.1 | 0.3 | 0.6 | 0.9 |

What is claimed is:

1. A process for multi-gradation thermal transfer recording of a multi-gradation image on a receptor, which comprises:

placing, on the receptor, a heat-sensitive transfer material comprising a substrate film, an adhesive layer on one surface of the substrate film, a heat-melting ink layer on the adhesive layer and a transfer control layer formed on the heat-melting ink layer, said transfer control layer formed by applying a dispersion of a heat-melting resin, a wax or heat-melting ink in a heat-resistant resin onto the heat-melting ink layer, and charging the heat-sensitive transfer material with various levels of energy depending upon image signals from the substrate side, wherein the heat-melting ink is transferred to the receptor in an amount that corresponds to the various levels of energy.

2. A multi-gradation heat-sensitive transfer material for transferring a heat-melting ink to a receptor according to an amount of charged energy, which comprises a substrate film, an adhesive layer on one surface of the substrate film, a heat-melting ink layer on the adhesive layer and a transfer control layer formed on the heat-melting ink layer, said transfer control layer formed by applying a dispersion of a heat-melting resin, a wax or a heat-melting ink in a heat-resistant resin onto the heat-melting ink layer.

3. A multi-gradation heat-sensitive transfer material according to claim 2, wherein the heat-melting resin is polymer comprising at least one compound of the formula (1)

$$CH_2{=}\overset{\overset{R_1}{|}}{C}{-}COOR_2 \qquad (1)$$

wherein $R_1$ represents a hydrogen atom or an alkyl group having 1 to 3 carbon atoms, and $R_2$ represents a long-chain alkyl group having not less than 17 carbon atoms;

and optionally at least one compound selected from the group consisting of formula (2)

$$CH_2{=}\overset{\overset{R_3}{|}}{C}{-}COOR_4 \qquad (2)$$

wherein $R_3$ represents a hydrogen atom or a methyl group and $R_4$ represents an alkyl group having up to 6 carbon atoms, and formula (3)

$$CH_2{=}\underset{\underset{R_5}{|}}{CH} \qquad (3)$$

wherein $R_5$ represents a cyano group, a phenyl group, an aminocarbonyl group or an acetoxy group.

4. A multi-gradation heat-sensitive transfer material according to claim 3 wherein the heat-melting ink is a polymer which is a product of suspension polymerization.

5. A multi-gradation heat-sensitive transfer material according to claim 2 wherein the transfer control layer is comprised of a cured thermosetting resin or irradiation-curable resin.

6. A multi-gradation heat-sensitive transfer material according to claim 2 wherein the other surface of the substrate film is provided with a heat-resistant layer.

7. A multi-gradation heat-sensitive transfer material according to claim 2 wherein the heat-melting ink layer comprises yellow, magenta and cyan coloring agents arranged side by side.

* * * * *